United States Patent [19]

Schoppa et al.

[11] 4,251,581

[45] Feb. 17, 1981

[54] MOLDABLE NON-WOVEN STRUCTURED TEXTILE SHEETS COMPRISING CO-POLYMERIC IMPREGNANT CONSISTING ESSENTIALLY OF 75-95% BY WEIGHT OF A THERMOPLASTIC COMPONENT AND 25-5% BY WEIGHT OF A PLASTICIZING COMPONENT

[75] Inventors: Claus Schoppa, Marl-Polsum; Wilhelm Fortmann, Schermbeck; Armin Stei, Dorsten, all of Fed. Rep. of Germany

[73] Assignee: Chemische Werke Huels A.G., Marl, Fed. Rep. of Germany

[21] Appl. No.: 844,416

[22] Filed: Oct. 21, 1977

[30] Foreign Application Priority Data

Oct. 21, 1976 [DE] Fed. Rep. of Germany ..... 2647522

[51] Int. Cl.[3] ..... B32B 27/04; B32B 27/12; B32B 27/30

[52] U.S. Cl. ..... 428/95; 264/136; 264/137; 427/374.1; 428/96; 428/290

[58] Field of Search ..... 428/290, 95, 96; 427/374 R; 264/136, 137

[56] References Cited

U.S. PATENT DOCUMENTS

| | | | |
|---|---|---|---|
| 3,199,167 | 8/1965 | Charlton et al. | 156/148 |
| 3,468,418 | 9/1969 | Silverman | 264/134 |
| 3,505,156 | 4/1970 | Handscomb | 428/95 |
| 3,684,645 | 8/1972 | Temple et al. | 156/166 |
| 3,817,899 | 6/1974 | Turck | 260/29.7 SQ |
| 3,940,537 | 2/1976 | Burns | 428/288 |
| 3,953,632 | 4/1976 | Robinson | 428/95 |
| 4,169,176 | 9/1979 | Hartmann et al. | 428/96 |

FOREIGN PATENT DOCUMENTS

| | | |
|---|---|---|
| 1660777 | 9/1971 | France . |
| 913772 | 12/1962 | United Kingdom . |
| 1329250 | 9/1973 | United Kingdom . |

OTHER PUBLICATIONS

Nirenberg, Modern Textiles Magazine (1962) May, pp. 48–53.

Reinhard, "Dispersions–High Polymers", Part II–application–in Chemie, Physik und Technologie der Kunstoffe in Einzeldarstellungen, Wolf, (1969) Springer–Verlag, pp. 17, 18 and 199–202.

German Utility Model 1,929,899.

German Utility Model 7,224,054.

*Primary Examiner*—James C. Cannon

*Attorney, Agent, or Firm*—Millen & White

[57] ABSTRACT

A structured, permanently moldable textile sheet is impregnated on the backside only with an aqueous synthetic resin dispersion, comprising a synthetic resin which comprises 75–95% by weight of a thermoplastic component and 5–25% by weight of a plasticizing component. The resultant impregnated sheet is thereby reinforced and can be permanently molded and glued to an underlying surface without additional preprocessing.

10 Claims, No Drawings

MOLDABLE NON-WOVEN STRUCTURED TEXTILE SHEETS COMPRISING CO-POLYMERIC IMPREGNANT CONSISTING ESSENTIALLY OF 75-95% BY WEIGHT OF A THERMOPLASTIC COMPONENT AND 25-5% BY WEIGHT OF A PLASTICIZING COMPONENT

BACKGROUND OF THE INVENTION

The present invention relates to permanently moldable structured sheets of textile materials which are reinforced and rendered permanently moldable by an aqueous synthetic resin dispersion.

The structured textile sheets of interest include, inter alia, needlefelt carpets used in automobile manufacturing.

Since such needlefelt carpets are nonwovens, they are customarily reinforced by synthetic resin dispersions, such as aqueous dispersions of styrene/butadiene copolymers, which may be carboxylated, as well as of acrylates, vinyl esters, etc. Such aqueous dispersions are described in F. Hölscher/H. Reinhard, Dispersionen synthetischer Hochpolymerer, Springer Verlag Berlin-Heidelberg-New York (1969), Vol. I+II and elsewhere.

In addition, they must be capable of being molded three-dimensionally for installation in automobiles, so that they conform to the generally curved shapes of the underlying surfaces, for example, fenders, universal shaft wells, etc. For this purpose, they must be permanently molded. As a result, such ready-for-use carpets are provided with an undercoating made of a polyethylene powder. The coating enables permanent forming of the carpets or other nonwoven textile sheets.

Such permanently formable needlefelt carpets possess two essential disadvantages. Their manufacture is expensive because of the aforementioned two manufacturing steps (reinforcing and undercoating), especially since these processes represent two entirely different techniques. Moreover, because of the poor adhesion displayed by the backing of polyethylene the needlefelt carpets cannot be joined to underlying surfaces by gluing in a practical manner. To overcome this disadvantage, a rayon mat must be inserted in the sintered polyethylene to enable gluing of the tufted mat carpets.

SUMMARY OF THE INVENTION

Accordingly, it is an object of this invention to enable production of a permanently moldable, structured textile sheet which does not exhibit the above-described disadvantages, but which otherwise can be utilized in the conventional manner.

This and other objects have been achieved by providing, in a composition aspect a structured textile sheet which is impregnated by means of an aqueous synthetic resin dispersion, the synthetic resin proportion of which consists of 75–95%, preferably 85–95%, by weight of thermoplastic component and of 5–25%, preferably 5–15%, by weight of a plasticizing component.

In a method aspect, this invention relates to a process for preparing a permanently moldable structured textile sheet which comprises impregnating a structured textile sheet with the aforedescribed aqueous synthetic resin dispersion.

DETAILED DISCUSSION

The term "component" refers to monomers of the appropriate type (thermoplastic or plasticizing) which are eventually incorporated in the resin by polymerization.

Suitable thermoplastic monomers include, for example, styrene, ethylene, as well as other conventional vinyl or acrylic monomers, which impart thermoplastic characteristics to a polymer.

Suitable plasticizing monomers include for example, butadiene, fumaric acid diesters, and other conventional plasticizing monomers.

Styrene and butadiene, as well as fumaric acid diesters are preferred.

In addition, up to 10% by weight, preferably up to 5% by weight, of reactive monomers can be included in the synthetic resin. Suitable such reactive monomers include unsaturated carboxylic acids and/or their esters as e.g. (meth-)acrylic acid, itaconic acid, $\beta$-hydroxyethylacrylate etc.; carboxylic acid amides as e.g. (meth-)acrylic acid amide; vinyl esters such as vinylacetate, vinylpropionate etc.; and similar monomers.

The above-described synthetic resin dispersions per se are known. The prior use of those synthetic resin dispersions is for instance described in F. Hölscher/H. Reinhard, Dispersionen synthetischer Hochpolymerer, Springer Verlag Berlin-Heidelberg-New York (1969), Vol. I+II. However, they have not been used to impregnate a structured textile sheet to simultaneously reinforce it and render it permanently moldable.

The polymer dispersions can be used individually or in mixtures with equally good results, as long as the required proportion between the total amounts of thermoplastic and plasticizing components is maintained. In practice, mixtures are preferred when the desired synthetic resin dispersion is too soft for a particular purpose. For example, when using an SBR latex having a high butadiene proportion as the starting dispersion, a homopolystyrene dispersion can be admixed thereto.

The synthetic resin content of the dispersions should be in the range of 10–60% by weight, preferably 40 to 60%. The water content is from 40 to 90%, preferably 40 to 60%. In addition, the dispersions may contain conventional auxiliary agents, such as thickeners, antistats, flame retardants, fillers and similar materials. The content of such adjuvants is normally from 50 to 200% total, preferably, 70 to 120% related to synthetic resin content of the dispersions. The compounds generally have viscosities from 10 to 30 sec, preferably 18 to 24 sec (Ford cup (6 mm)—DIN 53 211). It is also possible to apply the compounds in the form of a foam ready for processing. The aforementioned synthetic resin dispersions are made by known methods as described in F. Hölscher/H. Reinhard, Dispersionen synthetischer Hochpolymerer, Springer Verlag, Berlin-Heidelberg-New York (1969), Vol. I+II. Application of the compound at room temperature to the back of the textile sheet is effected e.g. with a lick roller or—in foamed compound application—with a mixer, thereby avoiding complete impregnation of the textile sheet. In other words, the sheet surface still has a textile character. Compound application is carried out at 200–600 g/m$^2$, preferably at 400–500 g/m$^2$. Depending on the textile fiber material used, the wet impregnated textile sheet is dried at 125°–180° C., the drying time being 4–6 mins. per meter of textile sheet velocity in the machine.

The application method, the quantity of compound applied and the application conditions within the limits described above are not critical.

Molding of the textile sheet is carried out by prior art procedures generally used to date. Unexpectedly, shorter heating and molding times result using this invention.

The state of the art has been described using as an example needlefelt carpets for automobiles. The invention is in no way limited to this aspect, but applies to structured textile components in general. Such products may be made by any of a number of conventional methods, such as, for example, by weaving, tufting, knitting, and/or by means of needlefelt techniques, etc.

The advantages of this invention apply to all such products. Textiles under this invention are natural fibers such as wool, cotton, flax, linen, jute, coconut fibers, etc., regenerated cellulose such as rayon, Cuprama® fibers, etc., or synthetic organic fibers made of polyesters, polyolefins, polyamides, polyacrylonitrile, polyvinylalcohols, etc. Of course, mixtures of the above fibers may be used as well. Fibers made of glass or rubber are not textile fibers per this invention.

The structured textile articles of this invention are significantly advantageous in that they need be subjected to only a single treatment prior to the molding operation. Moreover, conventional machines already present in manufacturing plants can be used. The properties of the products of this invention are fully equivalent to those of conventional materials, such as form stability, dimensional stability, fiber capillary anchorage characteristic, rigidity, texture, fiber abrasion, etc.

An additional unexpected advantage is afforded by the structured textile articles of this invention during the processing operation, in that the molding time is, in each case, less than 40% of the time required for conventional products. This time gain is due to the fact that both the heating and cooling periods can be drastically shortened. Consequently, a considerable savings in energy expended per item and an increase in machine efficiency due to the shortened cycle times, are realized.

Furthermore, the structured textile articles of this invention can be glued permanently and firmly to an underlying surface, without the need for the conventional additional processing.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples all temperatures are set forth uncorrected in degrees Celsius; unless otherwise indicated, all parts and percentages are by weight.

EXAMPLE

Monomers used in the Dispersions:

| | Monomer | Weight % |
|---|---|---|
| Dispersion (1) | Styrene | 75 |
| | Butadiene | 20 |
| | Acrylic acid | 5 |
| | Synthetic resin content | ~50 |
| Dispersion (2) | Styrene | 85 |
| | Butadiene | 10 |
| | Acrylic acid | 5 |
| | Synthetic resin content | ~50 |
| Dispersion (3) | Styrene | 100 |
| | Synthetic resin content | ~50 |

Compositions of the Compounds:

-continued

| | Component | Parts by Weight |
|---|---|---|
| Compound (I) | Dispersion (1) | 200 |
| | Water | 127 |
| | Thickener*(3% in $H_2O$) | 73 |
| | Total | 400 |
| Solids content of the compound | | 25.5% by weight |
| Viscosity of the compound: | | 14 sec.(Ford cup-6 mm)** |

| | Component | Parts by Weight |
|---|---|---|
| Compound (II) | Dispersion (2) | 200 |
| | Water | 50 |
| | Filler ($CaCO_3$) | 100 |
| | Thickener*(3% in $H_2O$) | 53 |
| | Total | 403 |
| Degree of filling of the compound: | | 100% by weight, based on the synthetic resin content of the dispersion |
| Solids content of the compound: | | 50% by weight |
| Viscosity of the compound: | | 30 sec.(Ford cup-6 mm)** |

| | Component | Parts by Weight |
|---|---|---|
| Compound (III) | Dispersion (1) | 100 |
| | Dispersion (3) | 50 |
| | Water | 12 |
| | Filler ($BaSO_4$) | 120 |
| | Thickener*(3% in $H_2O$ | 25 |
| | Total | 307 |
| Degree of filling of the dispersion: | | 160% by weight, based on the synthetic resin content of the dispersion |
| Solids content of the compound: | | 48.1% by weight |
| Viscosity of the compound: | | 26 sec. Ford cup-6 mm)** |

*The thickener was carboxymethylcellulose (type: 7 HCF of Hercules Powder Comp.)
**DIN 53 211

The experiments set forth in the table were conducted with needlefelt carpet samples used in commercially available passenger cars. For purposes of the experiments illustrating the invention, the crude carpet textile, not yet treated, was impregnated on the backside with the foamed compound (III) by means of a foam mixer (300 g of the dispersion/$m^2$) and then dried on a perforated cylinder drier in hot air at 150° C. The carpets containing polypropylene fibers were dried at 130° C.

Thereafter, the carpet was shaped into the appropriate configuration for the respective vehicle type. The shrinkage in the longitudinal and transverse directions was conventionally measured in accordance with the internal testing requirements of the respective vehicle manufacturer for each particular carpet. The following technical specifications were employed:

| | |
|---|---|
| VW [Volkswagen] | TL 480 selectively at 80° C. or 90° C. |
| Opel | TM 23 53 and 2347, respectively (24 hours at 90° C.) |
| Ford | SKM-8P 9502A FLPM-EU-BN 5-1 (30 Minutes at 80° C.) |

The results for dispersions (I) and (II) were of the same order of magnitude as those shown in the table for dispersion III.

For the comparative experiments (** in the table), original carpets from the running vehicle production lines were utilized. The manufacture of these carpets is described in general terms above in the discussion of the prior art. They were subjected to the same tests.

TABLE

| Molded Component from Vehicle Type | Fiber Mixture (***) of the Carpets | Cycle Period of Molding Step [sec.] | Maximum Shrinkage Value Predetermined by Vehicle Manufacturer [%] | | Measured Shrinkage Values [%] According to the Testing Conditions of the Respective Vehicle Manufacturer | | | |
|---|---|---|---|---|---|---|---|---|
| | | | | | 80° C. | | 90° C. | |
| | | | L (*) | Q (*) | L | Q | L | Q |
| | Polyester/ | 35 | — | — | 0.83 | 0.51 | 1.31 | 1.28 |
| Ford | Polyamide | 90 (**) | — | — | 1.28 | 0.90 | 1.32 | 1.47 |
| | 70:30 | 90 (**) | — | — | 2.04 | 1.15 | 2.11 | 1.65 |
| | Polyester/ | 35 | — | — | — | — | 0.66 | 1.40 |
| Opel | Polyamide | 35 | — | — | — | — | 0.34 | 0.56 |
| | 70:30 | 90 (**) | — | — | — | — | 0.33 | 1.95 |
| | Polyester/ | 35 | 1.0 | 1.5 | 0.54 | 1.09 | — | — |
| VW | Polyamide | 35 | 1.0 | 1.5 | 0.80 | 1.33 | — | — |
| | 70:30 | 35 | 1.0 | 1.5 | 0.19 | 0.54 | — | — |
| | Polypropylene/ | 35 | 2.5 | 2.5 | — | — | 0.72 | 1.73 |
| VW | Polyamide | 35 | 2.5 | 2.5 | — | — | 0.76 | 1.83 |
| | 70:30 | 35 | 2.5 | 2.5 | — | — | 1.34 | 2.33 |

(*) Measured in the longitudinal direction (L) and transverse direction (Q).
(**) Comparative tests using commercial carpets produced by methods of prior art.
(***) In these tests, products of Messrs. Besmer, Vereinigte Wollwarenfabriken, Hameln/Federal Republic of Germany were used as needlefelts. The products are in compliance with the above technical specifications of the car manufacturers in question.

The preceding example can be repeated with similar success by substituting the generically or specifically described reactants and/or operating conditions of this invention for those used in the preceding example.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A structured, permanently moldable textile sheet which is prepared by a process consisting essentially of (a) impregnating only the back of a textile sheet with an aqueous dispersion of a synthetic resin, while avoiding complete impregnation of the textile sheet, consisting essentially of 75–95% by weight of a thermoplastic component and 5–25% by weight of a plasticizing component; and (b) drying the impregnated sheet.

2. The structured textile sheet of claim 1, wherein the synthetic resin consists of 85–95% by weight of a thermoplastic component and 5–15% by weight of a plasticizing component.

3. The structured textile sheet of claim 1, wherein the synthetic resin, consists of said thermoplastic and plasticizing components and up to 10% by weight of a reactive monomer.

4. The structured textile sheet of claim 1, wherein the dispersion comprises 10–16 weight % of synthetic resin.

5. The structured textile sheet of claim 1, wherein the thermoplastic component is styrene and the plasticizing component is butadiene.

6. The structured textile sheet of claim 1, wherein the textile sheet is a needlefelt carpet.

7. A molded, structured textile sheet which is prepared by directly molding the impregnated and dried moldable textile sheet of claim 1.

8. The molded sheet of claim 7 which is shaped as an automobile mat.

9. A method for preparing a moldable, structure textile sheet which consists essentially of impregnating only the back of a textile sheet with an aqueous synthetic resin dispersion as defined in claim 1 and drying the resultant textile sheet.

10. A method for preparing a molded, structured textile sheet which comprises impregnating only the back of a textile sheet with an aqueous synthetic resin dispersion as defined in claim 1; drying and directly molding the resultant sheet.

* * * * *

UNITED STATES PATENT AND TRADEMARK OFFICE

CERTIFICATE OF CORRECTION

PATENT NO. : 4,251,581

DATED : February 17, 1981

INVENTOR(S) : CLAUS SCHOPPA ET AL

It is certified that error appears in the above—identified patent and that said Letters Patent is hereby corrected as shown below:

Column 6, line 30: reads "dispersion comprises 10-16 weight % of synthetic resin."

should read -- dispersion comprises 10-60 weight % of synthetic resin. --.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*